US010514648B2

(12) United States Patent
Mutsuo et al.

(10) Patent No.: US 10,514,648 B2
(45) Date of Patent: Dec. 24, 2019

(54) IMAGE FORMING APPARATUS AND TONER AMOUNT CALCULATING METHOD

(71) Applicant: KYOCERA Document Solutions Inc., Osaka (JP)

(72) Inventors: Toshiaki Mutsuo, Osaka (JP); Hiroki Tanaka, Osaka (JP); Takayuki Mashimo, Osaka (JP)

(73) Assignee: Kyocera Documents Solutions, Inc. (JP)

( * ) Notice: Subject to any disclaimer, the term of this patent is extended or adjusted under 35 U.S.C. 154(b) by 0 days.

(21) Appl. No.: 16/123,153

(22) Filed: Sep. 6, 2018

(65) Prior Publication Data

US 2019/0079440 A1 Mar. 14, 2019

(30) Foreign Application Priority Data

Sep. 8, 2017 (JP) ..... 2017-172616

(51) Int. Cl.

*G03G 15/00* (2006.01)
*G03G 15/04* (2006.01)
*G03G 15/16* (2006.01)
*G03G 15/08* (2006.01)

(52) U.S. Cl.

CPC ..... *G03G 15/556* (2013.01); *G03G 15/04045* (2013.01); *G03G 15/04072* (2013.01); *G03G 15/0865* (2013.01); *G03G 15/16* (2013.01); *G03G 15/5041* (2013.01); *G03G 15/5087* (2013.01)

(58) Field of Classification Search

CPC ..... G03G 15/556; G03G 15/04045; G03G 15/04072; G03G 15/0865; G03G 15/16; G03G 15/5041; G03G 15/5087

See application file for complete search history.

(56) References Cited

U.S. PATENT DOCUMENTS 5,867,198 A * 2/1999 Gwaltney ..... H04N 1/233 347/131
5,950,043 A * 9/1999 Fujita ..... G03G 15/0131 399/29
2004/0042805 A1* 3/2004 Takamatsu ..... G03G 15/553 399/27

(Continued)

FOREIGN PATENT DOCUMENTS

JP 2007-133186 5/2007
JP 2012-150182 8/2012

*Primary Examiner* — Ryan D Walsh

(57) ABSTRACT

An exposure device irradiates a photoconductor with light on the basis of an exposure signal and thereby forms an electrostatic latent image. A toner amount calculating unit (a) determines a distribution pattern of the electrostatic latent image on the basis of the exposure signal, (b) determines an electric field variation level of a target pixel, (c) determines an electric field intensity of the target pixel on the basis of a value of the target pixel in the distribution pattern and the electric field variation level, and (d) determines a toner consumption amount corresponding to the electric field intensity. Further, using spatial filters independently of each other in a primary scanning direction and in a secondary scanning direction, the toner amount calculating unit determines the electric field variation level on the basis of (a) the distribution pattern or (b) the exposure signal.

5 Claims, 7 Drawing Sheets

(56) References Cited

U.S. PATENT DOCUMENTS

| | | | | |
|---|---|---|---|---|
| 2004/0196479 | A1* | 10/2004 | Foster | G06T 7/60 358/1.9 |
| 2006/0204257 | A1* | 9/2006 | Kawano | G03G 15/553 399/27 |
| 2007/0103717 | A1 | 5/2007 | Ono | |
| 2015/0220035 | A1* | 8/2015 | Yamazaki | G06K 15/4075 399/27 |
| 2017/0064140 | A1* | 3/2017 | Mutsuo | H04N 1/4052 |
| 2018/0011421 | A1* | 1/2018 | Ogasahara | G03G 15/0856 |
| 2019/0079439 | A1* | 3/2019 | Mutsuo | G03G 15/556 |
| 2019/0079441 | A1* | 3/2019 | Mutsuo | G03G 15/556 |
| 2019/0079442 | A1* | 3/2019 | Mutsuo | G03G 15/556 |
| 2019/0079443 | A1* | 3/2019 | Mutsuo | G03G 15/04072 |
| 2019/0080213 | A1* | 3/2019 | Mutsuo | G03G 15/556 |

* cited by examiner

IMAGE FORMING APPARATUS AND TONER AMOUNT CALCULATING METHOD

CROSS-REFERENCE TO RELATED APPLICATIONS

This application relates to and claims priority rights from Japanese Patent Application No. 2017-172616, filed on Sep. 8, 2017, the entire disclosures of which are hereby incorporated by reference herein.

BACKGROUND

1. Field of the Present Disclosure

The present disclosure relates to an image forming apparatus and a toner amount calculating method.

2. Description of the Related Art

An electrophotographic image forming apparatus such as a printer or a multi function peripheral obtains toner from a toner cartridge and forms an image using the toner. Some of such image forming apparatuses measure a toner consumption amount.

In an electrophotographic image forming apparatus, an electrostatic latent image is formed on a photoconductor drum or the like. An edge electric field appears at a boundary part between a part with a dot of an electrostatic latent image and a part without a dot of an electrostatic latent image, and consequently toner is consumed more than needed. This phenomenon is called "edge effect". Therefore, a lot of methods have been proposed for calculating a toner consumption amount with taking the edge effect into account.

An image forming apparatus determines an electric field intensity of a target pixel on the basis of an exposure signal of laser light with taking a distribution pattern of a surrounding electrostatic latent image into account, and determines a toner consumption amount on the basis of the electric field intensity.

Further, in an image forming apparatus, an exposure energy of each subpixel is calculated with taking a laser light profile (i.e. a spatial intensity distribution) into account, and a toner consumption amount is calculated on the basis of the exposure energy.

In the aforementioned image forming apparatus, an electric field variation of the target pixel due to the distribution pattern of the electrostatic latent image is estimated using a spatial filter under an assumption that an electric field intensity distribution pattern of each pixel is in inverse proportion to a second power of a distance from the pixel. Meanwhile, filter coefficients of such spatial filter is set so as to provide the electric field variation of the target pixel based on the distribution pattern of the electrostatic latent image on adjacent pixels of the target pixel in an actual device.

However, the edge effect sometimes results in different influence between in a primary scanning direction and in a secondary scanning direction, and therefore, when using the aforementioned spatial filter in inverse proportional to a second power of the distance, the filter coefficients must be determined with taking both of edge effect in the primary scanning direction and edge effect in the secondary scanning direction into account. Therefore, lots of work are required to adjust the filter coefficients to provide a proper electric field variation of the target pixel.

SUMMARY

An image forming apparatus according to an aspect of the present disclosure includes a photoconductor, an exposure device and a toner amount calculating unit. The exposure device is configured to irradiate the photoconductor with light on the basis of an exposure signal and thereby form an electrostatic latent image. The toner amount calculating unit is configured to calculate a toner consumption amount on the basis of the exposure signal. The toner amount calculating unit (a) determines a distribution pattern of the electrostatic latent image on the basis of the exposure signal, (b) determines an electric field variation level of a target pixel on the basis of the distribution pattern of the electrostatic latent image or the exposure signal, (c) determines an electric field intensity of the target pixel on the basis of a value of the target pixel in the distribution pattern of the electrostatic latent image and the electric field variation level, and (d) determines a toner consumption amount corresponding to the electric field intensity. Further, using spatial filters independently of each other in a primary scanning direction and in a secondary scanning direction, the toner amount calculating unit determines the electric field variation level of the target pixel on the basis of (a) the distribution pattern of the electrostatic latent image or (b) the exposure signal.

A toner amount calculating method in an image forming apparatus that comprises a photoconductor and an exposure device configured to irradiate the photoconductor with light on the basis of an exposure signal and thereby form an electrostatic latent image, according to an aspect of the present disclosure, includes the steps of: determining a distribution pattern of the electrostatic latent image on the basis of the exposure signal in an electrostatic latent image distribution determining step; determining an electric field variation level of a target pixel on the basis of the distribution pattern of the electrostatic latent image or the exposure signal in an electric field variation level determining step; and determining an electric field intensity of the target pixel on the basis of (a) a value of the target pixel in the distribution pattern of the electrostatic latent image and (b) the electric field variation level and determining a toner consumption amount corresponding to the electric field intensity. Further, in the electric field variation level determining step, using spatial filters independently of each other in a primary scanning direction and in a secondary scanning direction, the electric field variation level of the target pixel is determined on the basis of (a) the distribution pattern of the electrostatic latent image and (b) the exposure signal.

These and other objects, features and advantages of the present disclosure will become more apparent upon reading of the following detailed description along with the accompanied drawings.

DETAILED DESCRIPTION

Hereinafter, embodiments according to an aspect of the present disclosure will be explained with reference to drawings.

Embodiment 1

Figure 1:
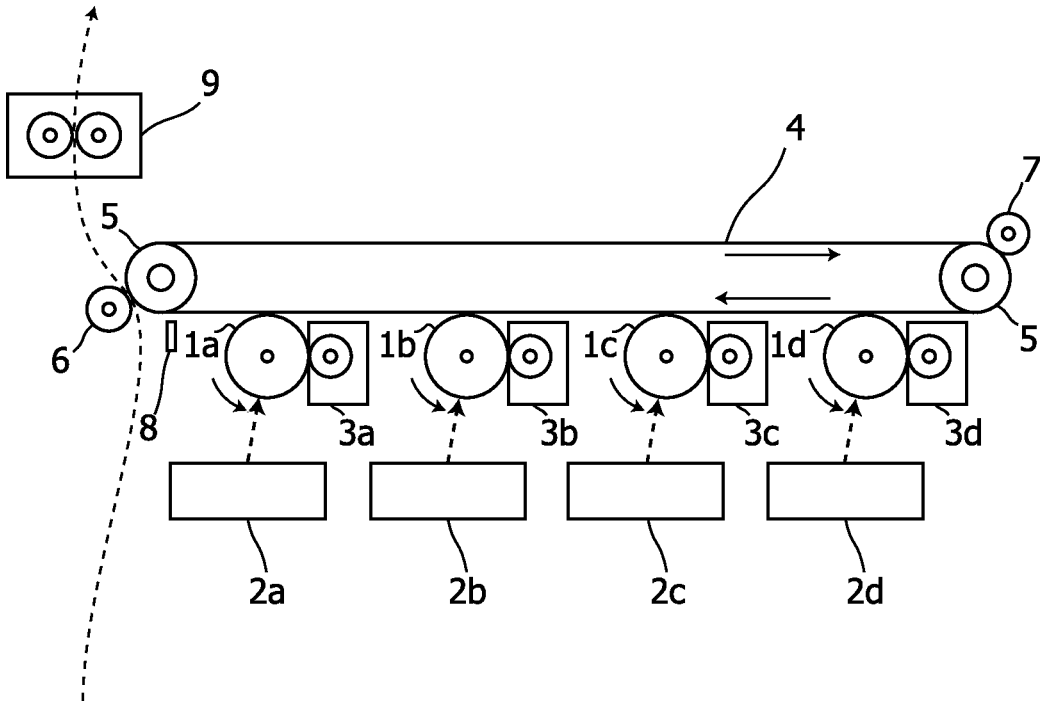
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. This image forming apparatus is an apparatus having a printing function such as a printer, a facsimile machine, a copier or a multi function peripheral.

The image forming apparatus in this embodiment includes a tandem-type color development device. This color development device includes photoconductor drums 1*a* to 1*d*, exposure devices 2*a* to 2*d*, and development units 3*a* to 3*d*. The photoconductor drums 1*a* to 1*d* are photoconductors of four colors: Cyan, Magenta, Yellow and Black.

The exposure devices 2*a* to 2*d* are devices that form electrostatic latent images by scanning and irradiating the photo conductor drums 1*a* to 1*d* with laser light, respectively. The photo conductor drum 1*a*, 1*b*, 1*c* or 1*d* is scanned with the laser light in a direction (a primary scanning direction) perpendicular to a rotation direction (a secondary scanning direction) of the photo conductor drum. The exposure devices 2*a* to 2*d* include laser scanning units that include laser diodes as light sources of the laser light, optical elements (such as lens, mirror and polygon mirror) that guide the laser light to the photo conductor drums 1*a* to 1*d*, respectively.

Further, in the periphery of each one of the photo conductor drums 1*a* to 1*d*, a charging unit such as scorotron, a cleaning device, a static electricity eliminator and the like are disposed. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

The development unit 3*a*, 3*b*, 3*c* or 3*d* includes a toner cartridge and a development device. The toner cartridge contains toner of one of four colors: Cyan, Magenta, Yellow, and Black. The toner is supplied from a toner hopper in the toner cartridge to the development device. The development device adheres the toner on the photoconductor drum 1*a*, 1*b*, 1*c*, or 1*d*. The development unit 3*a*, 3*b*, 3*c*, or 3*d* forms a toner image by adhering the toner to an electrostatic latent image on the photoconductor drum 1*a*, 1*b*, 1*c*, or 1*d*.

The photoconductor drum 1*a* and the development unit 3*a* perform development of Magenta. The photoconductor drum 1*b* and the development unit 3*b* perform development of Cyan. The photoconductor drum 1*c* and the development unit 3*c* perform development of Yellow. The photoconductor drum 1*d* and the development unit 3*d* perform development of Black.

An intermediate transfer belt 4 is a loop-shaped image carrier (here an intermediate transfer member), and contacts the photoconductor drums 1*a* to 1*d*. Toner images on the photoconductor drums 1*a* to 1*d* are primarily transferred onto the intermediate transfer belt 4. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

A transfer roller 6 causes a conveyed paper sheet to contact the transfer belt 4, and secondarily transfers the toner image on the transfer belt 4 to the paper sheet. The paper sheet on which the toner image has been transferred is transported to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet.

A sensor 8 irradiates the intermediate transfer belt 4 with a light beam, and detects its reflection light from a surface of the intermediate transfer belt 4 or a toner pattern on the intermediate transfer belt 4. For example, in density adjustment, the sensor 8 irradiates a predetermined area on the intermediate transfer belt 4 with a light beam, detects its reflection light, and outputs an electrical signal corresponding to the detected intensity of the reflection light.

Figure 2:
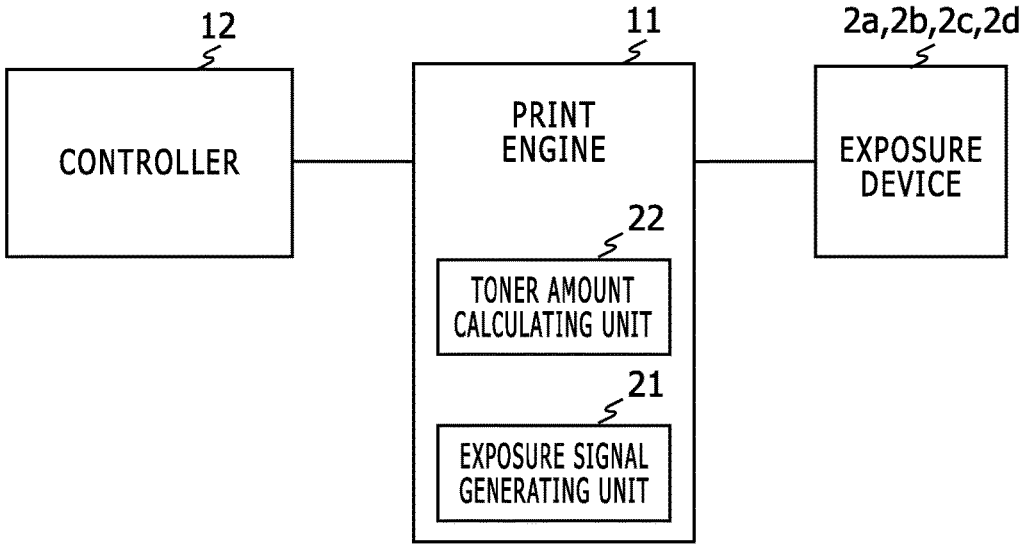
FIG. 2 shows a block diagram that indicates an electronic configuration of the image forming apparatus in the embodiment according to the present disclosure.

FIG. 2 shows a block diagram that indicates an electronic configuration of the image forming apparatus in the embodiment according to the present disclosure. This image forming apparatus includes a print engine 11 and a controller 12.

In FIG. 2, the print engine 11 is an electronic circuit that controls (a) driving mechanisms for electrophotography process and paper sheet transportation and (b) the exposure devices 2*a* to 2*d*. The print engine 11 performs printing in accordance with image data received from the controller 12. For example, the driving mechanism of paper sheet transportation includes motors that drive rollers for (a) feeding a paper sheet, (b) transporting a paper sheet to the aforementioned development device and the fuser 9, (c) outputting a paper sheet after completion of printing, and the like. For example, the driving mechanism of an electrophotography process includes (a) motors that drive the photoconductor drums 1*a* to 1*d*, the intermediate transfer belt 4 and the like, and (b) motors for laser scanning in the exposure devices 2*a* to 2*d*.

The controller 12 provides to the print engine 11 the image data of each toner color after the image processing such as the color conversion, half toning and the like.

The print engine 11 includes am exposure signal generating unit 21 and a toner amount calculating unit 22. The exposure signal generating unit 21 generates an exposure signal on the basis of image data received from the controller 12. The exposure signal indicates on each pixel (a) whether the pixel is irradiated with light or not on the basis of the image data received from the controller 12. Using this exposure signal, the print engine 11 causes the exposure device 2*a*, 2*b*, 2*c* or 2*d* to operate.

The toner amount calculating unit 22 calculates a toner consumption amount due to printing and the like performed in this image forming apparatus. Further, the toner amount calculating unit 22 calculates a toner residual amount in a toner cartridge from the toner consumption amount. Furthermore, the toner amount calculating unit 22 displays an integrated value of the toner consumption amount and/or the toner residual amount on an operation panel (not shown) and/or displays a warning message on operation panel (not shown) when the toner residual amount gets a low level.

The toner amount calculating unit 22 (a) determines a distribution pattern of the electrostatic latent image on the basis of the exposure signal, (b) determines an electric field variation level of a target pixel on the basis of the distribution pattern of the electrostatic latent image or the exposure signal, (c) determines an electric field intensity of the target pixel on the basis of (c1) a value of the target pixel in the distribution pattern of the electrostatic latent image and (c2) the electric field variation level, and (d) determines a toner consumption amount corresponding to the electric field intensity. In this process, using spatial filters independently of each other in a primary scanning direction and in a secondary scanning direction, the toner amount calculating unit 22 determines the electric field variation level of the target pixel on the basis of (a) the distribution pattern of the electrostatic latent image or (b) the exposure signal. Specifically, the filter process in one of the primary and secondary scanning directions is performed and thereafter for a result of this filter process the filter process in the other of the primary and secondary scanning directions is performed, and thereby the electric field variation level of the target pixel is determined.

Figure 3:
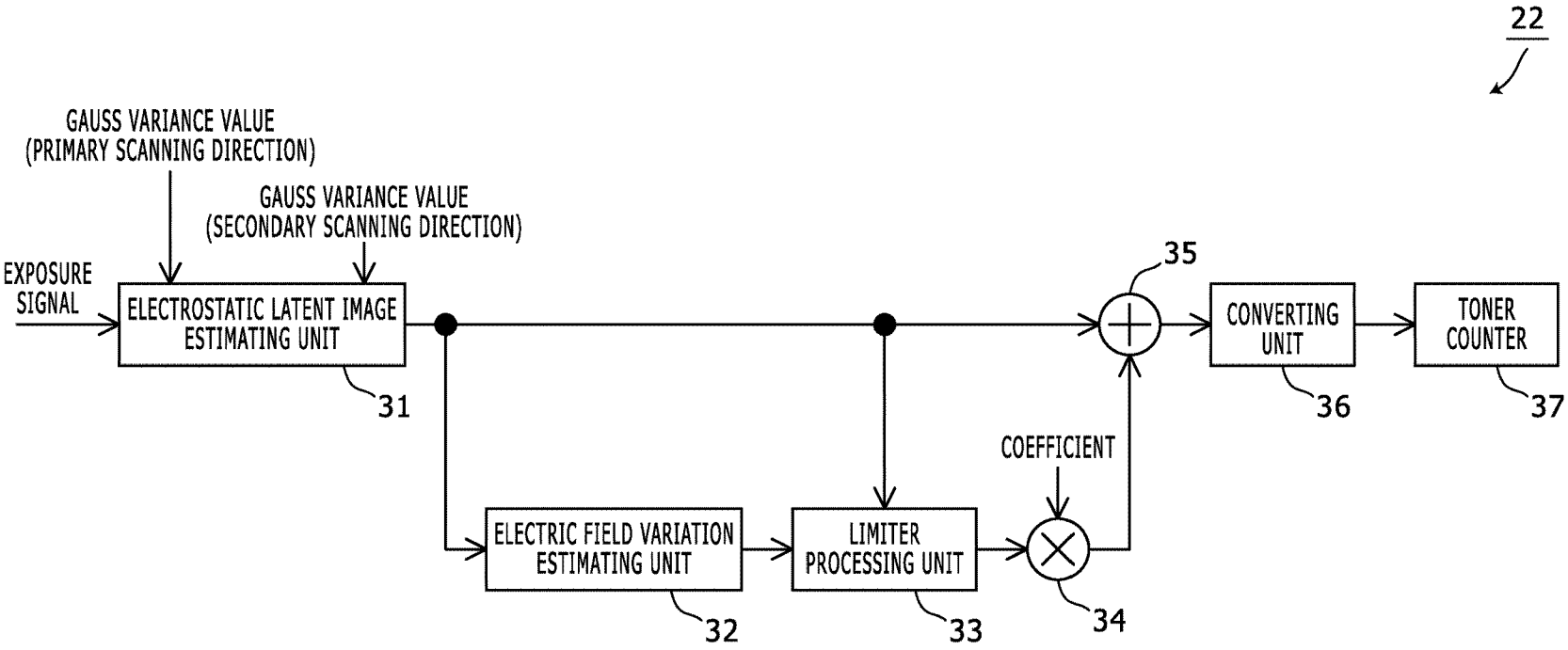
FIG. 3 shows a block diagram that indicates a configuration of a toner amount calculating unit 22 in Embodiment 1.

FIG. 3 shows a block diagram that indicates a configuration of a toner amount calculating unit 22 in Embodiment 1.

As shown in FIG. 3, the toner amount calculating unit 22 includes an electrostatic latent image estimating unit 31, an electric field variation estimating unit 32, a limiter processing unit 33, a multiplying unit 34, an adding unit 35, a converting unit 36, and a toner counter 37.

The electrostatic latent image estimating unit 31 determines a distribution pattern of the electrostatic latent image on the basis of the exposure signal. Specifically, the electrostatic latent image estimating unit 31 applies a low pass filter to a distribution pattern of the exposure signal and thereby determines the distribution pattern of the electrostatic latent image. In this embodiment, this low pass filter is a Gaussian filter. The electrostatic latent image estimating unit 31 determines the filter coefficients on the basis of preset Gauss variance values in the primary and secondary scanning directions. These Gauss variance values are specified on the basis of a profile of laser light emitted from the exposure device 2*a*, 2*b*, 2*c* or 2*d*. Further, the electrostatic latent image estimating unit 31 determines the distribution pattern of the electrostatic latent image on the basis of the exposure signal using Gaussian filters independently of each other in the primary scanning direction and in the secondary scanning direction. Specifically, the filter process in one of the primary and secondary scanning directions is performed and thereafter for a result of this filter process the filter process in the other of the primary and secondary scanning directions is performed, and thereby the distribution pattern of the electrostatic latent image is determined.

In the filter processes in the electrostatic latent image estimating unit 31 for the target pixel, a sum of a product of (a) a value of the exposure signal and (b) the filter coefficient at each adjacent pixel position is calculated.

Further, the electric field variation estimating unit calculates an electric field variation level of the target pixel on the basis of the distribution pattern of the electrostatic latent image obtained by the electrostatic latent image estimating unit 31. The electric field variation estimating unit 32 determines the electric field variation level of the target pixel on the basis of an electric field intensity distribution pattern caused by each pixel in the distribution pattern of the electrostatic latent image. Here it is assumed that the electric field intensity distribution pattern caused by each pixel is in inverse proportion to a second power of a distance from the pixel.

The electric field variation level at the target pixel is caused by the electric field intensity distribution patterns of adjacent pixels (i.e. pixels in a range of a filter size of the filter that the target pixel is located at the center of the filter) of the target pixel, and is determined in the filter processes using spatial filters independently of each other in the primary scanning direction and in the secondary scanning direction.

In Embodiment 1, using unsharp mask filters independently of each other in a primary scanning direction and in a secondary scanning direction, the toner amount calculating unit 22 determines the electric field variation level of the target pixel on the basis of the distribution pattern of the electrostatic latent image.

The limiter processing unit 33 limits the electric field variation level of the target pixel to an uppermost value or less, and this uppermost value corresponds to a value of the target pixel in the distribution pattern of the electrostatic latent image obtained by the electrostatic latent image estimating unit 31. Specifically, the limiter processing unit 33 determines a threshold value corresponding to the value of the target pixel in the distribution pattern of the electrostatic latent image, and sets the electric field variation level as this threshold value if the electric field variation level exceeds this threshold value.

The limiter processing unit 33 sets the higher uppermost value (i.e. the higher threshold value) for the larger value of the target pixel in the distribution pattern of the electrostatic latent image. The limiter processing unit 33 determines the aforementioned threshold value on the basis of the value of the target pixel in the distribution pattern of the electrostatic latent image by using a conversion formula as a linear formula, a lookup table or the like.

The limiter processing unit 33 is installed if required, and may be not required and not installed when the electric field variation level obtained by the electric field variation estimating unit 32 has a certain characteristic.

The multiplying unit 34 multiplies a predetermined coefficient by the electric field variation level of the target pixel obtained by the electric field variation estimating unit 32 (or equal to the uppermost value of the limiter processing unit 33) and thereby adjusts a gain of the electric field variation level (i.e. a filter gain).

The adding unit 35 calculates as an electric field intensity of the target pixel a sum of (a) a value obtained by the multiplying unit 34 (i.e. the electric field variation level after the gain adjustment) and (b) an output value of the electrostatic latent image estimating unit 31 (i.e. an electric field intensity component based on a laser profile due to laser irradiation of the target pixel).

The converting unit 36 converts a value of the electric field intensity of the target pixel obtained by the adding unit 35 to a toner consumption amount of the target pixel. For example, the converting unit 36 includes a lookup table and derives the toner consumption amount by referring to the lookup table.

The toner counter 37 calculates an integrated value (total value) of a toner consumption amount, of each page or from replacement time of the toner cartridge, on the basis of information on the toner consumption amount of each pixel obtained by the converting unit 36.

The following part explains a behavior of the image forming apparatus in Embodiment 1.

When image data is provided from the controller 12 to the print engine 11, the exposure signal generating unit 21 generates exposure signals on the basis of the image data.

The exposure signals are provided to the exposure devices 2*a* to 2*d*, and the exposure devices 2*a* to 2*d* irradiate the photoconductor drums 1*a* to 1*d* with light on the basis of the exposure signals and thereby form electrostatic latent images with respective toner colors.

Further, in the print engine 11, the exposure signal is provided to the toner amount calculating unit 22, and the toner amount calculating unit 22 calculates a toner consumption amount based on the exposure signal.

In the toner amount calculating unit 22, the electrostatic latent image estimating unit 31 keeps the exposure signal in turn in line buffers for a predetermined number of pixel lines, and applies a spatial filter to pixel values of the exposure signal kept in the line buffers, and thereby calculates an electrostatic latent image level (that corresponds to a negative electric charge) of the target pixel (i.e. the center pixel of the filter).

Subsequently, the electric field variation estimating unit 32 keeps outputs of the electrostatic latent image estimating unit 31 in line buffers for a predetermined number of pixel lines, and applies a spatial filter (e.g. an unsharp mask filter in Embodiment 1) to pixel values kept in the line buffers, and thereby calculates a variation amount of an electric field intensity of the target pixel (i.e. the center pixel of the filter).

Subsequently, the multiplying unit 34 multiplies a coefficient by the variation amount of the electric field intensity of the target pixel. This coefficient is preset on the basis of an experiment or the like.

The adding unit 35 adds an output value of the multiplying unit 34 to an output value of the electrostatic latent image estimating unit 31 for the target pixel, and thereby an electric field intensity of the target pixel is calculated.

Subsequently, the converting unit 36 calculates a toner consumption amount corresponding to the electric field intensity of the target pixel and provides the calculated toner consumption amount to the toner counter 37. The toner counter 37 increases the integrated value of the toner consumption amount by the toner consumption amount of the target pixel.

Figure 4:
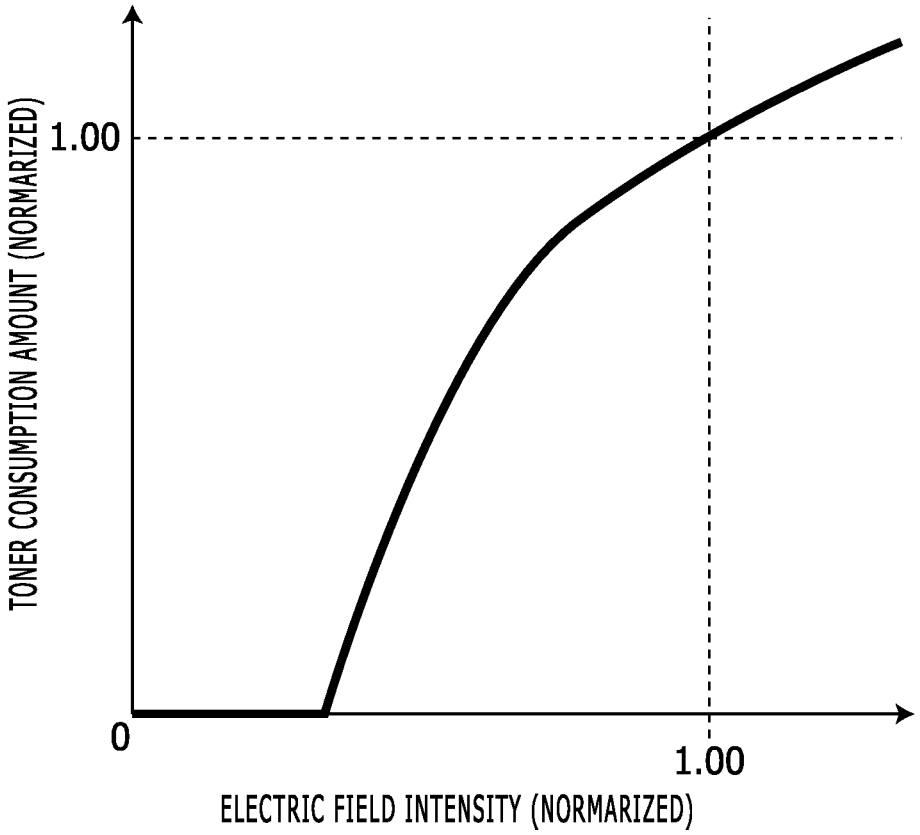
FIG. 4 shows a diagram that indicates an example of a relationship between an electric field intensity and a toner consumption amount in a converting unit 36 shown in FIG. 3.

FIG. 4 shows a diagram that indicates an example of a relationship between an electric field intensity and a toner consumption amount in the converting unit 36 shown in FIG. 3. The electric field intensity shown in FIG. 4 takes values normalized with an electric field intensity for a solid image with a highest toner density (i.e. values when an electric field intensity for a solid image with a highest toner density is expressed as 1). In addition, the toner consumption amount shown in FIG. 4 takes values normalized with a toner consumption amount per pixel in a solid image with a highest toner density (i.e. values when a toner consumption amount per pixel in a solid image with a highest toner density is expressed as 1).

As mentioned, in Embodiment 1, the exposure device 2*a*, 2*b*, 2*c* or 2*d* irradiates the photoconductor drum 1*a*, 1*b*, 1*c* or 1*d* with light based on an exposure signal and thereby forms an electrostatic latent image. The toner amount calculating unit 22 (a) determines a distribution pattern of the electrostatic latent image on the basis of the exposure signal, (b) determines an electric field variation level of a target pixel on the basis of the distribution pattern of the electrostatic latent image or the exposure signal, (c) determines an electric field intensity of the target pixel on the basis of (c1) a value of the target pixel in the distribution pattern of the electrostatic latent image and (c2) the electric field variation level, and (d) determines a toner consumption amount corresponding to the electric field intensity.

Specifically, using spatial filters independently of each other in a primary scanning direction and in a secondary scanning direction, the toner amount calculating unit 22 determines the electric field variation level of the target pixel on the basis of (a) the distribution pattern of the electrostatic latent image or (b) the exposure signal.

As mentioned, the spatial filters are independent of each other in the primary scanning direction and in the secondary scanning direction, and therefore adjustment of the primary scanning directional spatial filter and adjustment of the secondary scanning directional spatial filter can be performed independently. Consequently, complicated adjustment works are not required for the spatial filters, and thus, such adjustment works are performed at low cost for the spatial filters to obtain an electric field variation of a target pixel from a distribution pattern of an electrostatic latent image of adjacent pixels of the target pixel.

Embodiment 2

Figure 5:
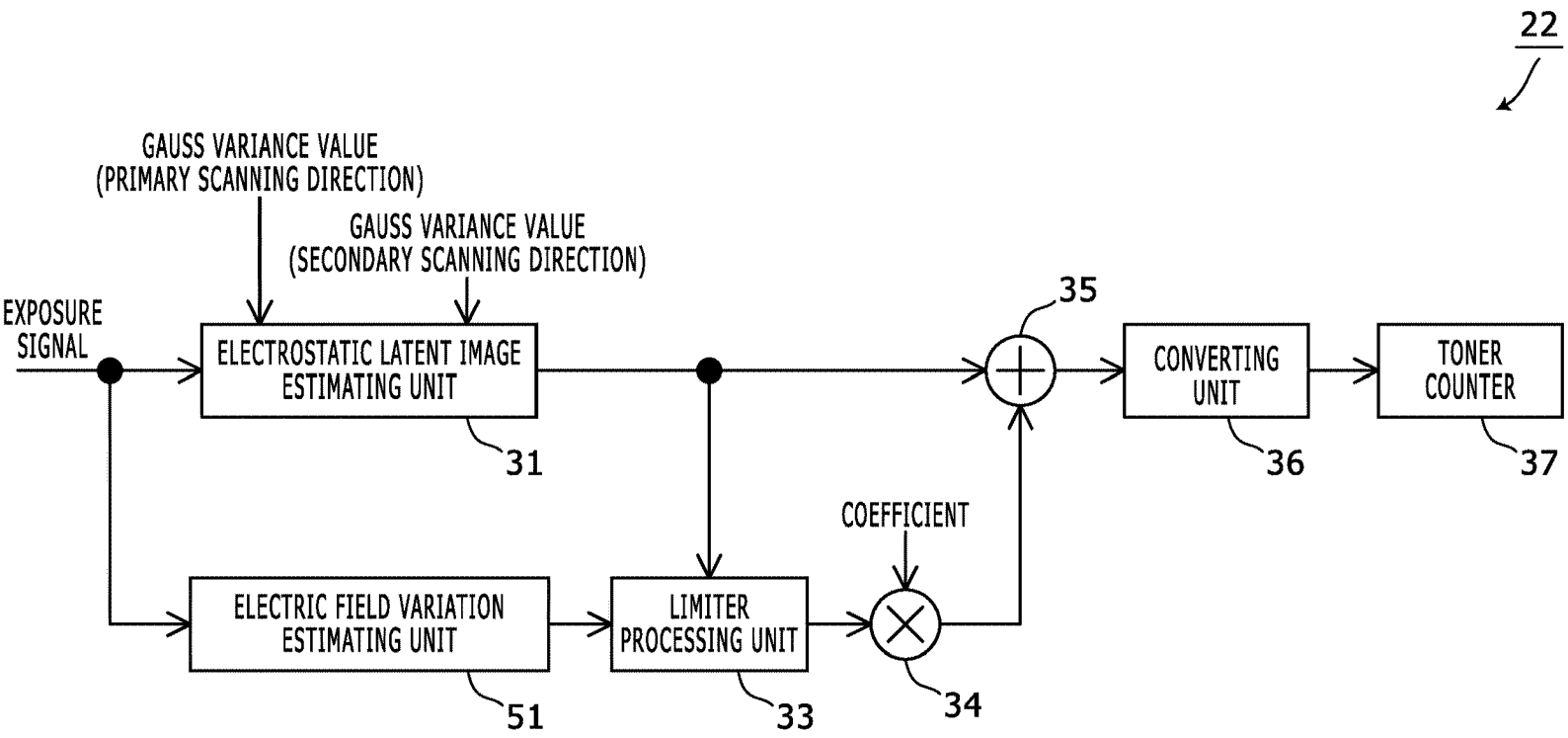
FIG. 5 shows a block diagram that indicates a configuration of a toner amount calculating unit 22 in Embodiment 2.

FIG. 5 shows a block diagram that indicates a configuration of a toner amount calculating unit 22 in Embodiment 2. In Embodiment 2, an electric field variation estimating unit 51 is used instead of the electric field variation estimating unit 32. The electric field variation estimating unit 51 determines an electric field variation level on the basis of the exposure signal by using a DoG (Difference-of-Gaussian) filter. Specifically, the electric field variation estimating unit 51 determines the electric field variation level on the basis of the exposure signal using Difference-of-Gaussian filters independently of each other in the primary scanning direction and in the secondary scanning direction. Specifically, in the filter processes, a sum of products of filter coefficients and pixel values of adjacent pixels corresponding to the target pixel and the filter size is calculated as a result of this filter process for the target pixel.

Figure 6:
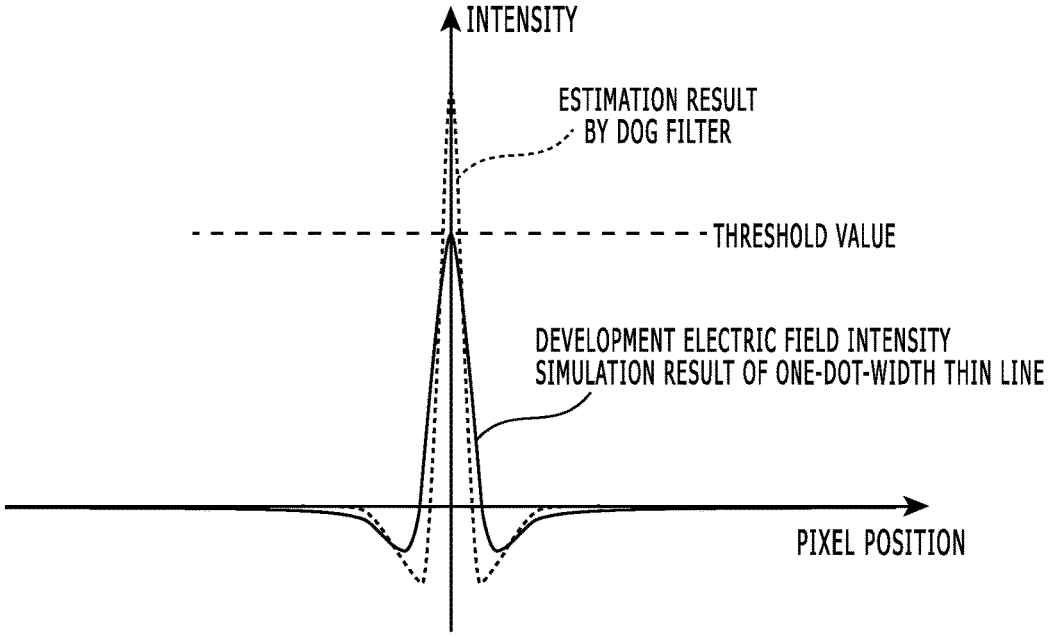
FIG. 6 shows a diagram that explains a behavior of a limiter processing unit 33 in Embodiment 2.

FIG. 6 shows a diagram that explains a behavior of a limiter processing unit 33 in Embodiment 2. As shown in FIG. 6, in case of one-dot width thin line, an electric field intensity derived by the DoG filter has a higher peak than an actual electric field distribution. Therefore, as mentioned, the aforementioned threshold value (i.e. the aforementioned uppermost value) is set to be lower than a peak of the electric field variation level in an edge part of a thin line. Consequently, the electric field variation level is limited due to this threshold value, and thereby an error on the toner consumption amount is restrained.

In the aforementioned Difference-of-Gaussian filter, two Gaussian filters of which variance values are different from each other are used, and a difference of output values of these Gaussian filters is set as an output value of the Difference-of-Gaussian filter.

Figure 7:
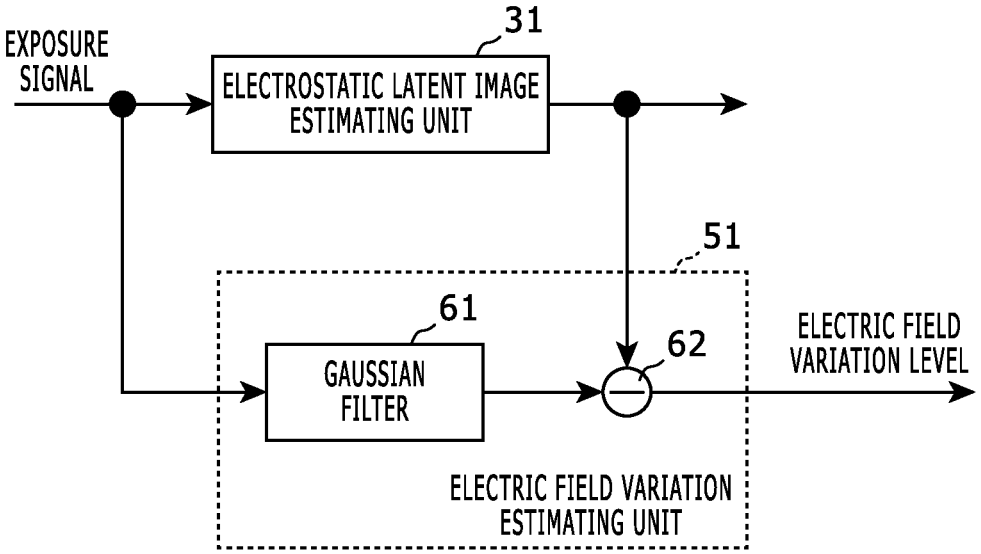
FIG. 7 shows a block diagram that indicates an example of an electric field variation estimating unit 51 in Embodiment 2.

FIG. 7 shows a block diagram that indicates an example of the electric field variation estimating unit 51 in Embodiment 2. When the electrostatic latent image estimating unit 31 uses the Gaussian filters in order to determine a distribution pattern of the electrostatic latent image on the basis of the exposure signal, as shown in FIG. 7, the electric field variation estimating unit 51 may include a Gaussian filter 61 and a subtractor 62, and a variance value of the Gaussian filter 61 is different from the Gaussian filter of the electrostatic latent image estimating unit 31; and the aforementioned Difference-of-Gaussian filter may be formed with the Gaussian filter of the electrostatic latent image estimating unit 31, the Gaussian filter 61 of the electric field variation estimating unit 51, and the subtractor 62. Thus, the electric field variation estimating unit 51 may include only one Gaussian filter 61 with a larger variance value among two Gaussian filters of the Difference-of-Gaussian filter, and may use the Gaussian filter of the electrostatic latent image estimating unit 31 as a Gaussian filter with a lower variance value among the two Gaussian filters. In such a case, a difference between an output value of the Gaussian filter 61 and an output value of the electrostatic latent image estimating unit 31, that is derived by the subtractor 62, is set as an output value of the electric field variation estimating unit 51.

Other parts of the configuration and behaviors of the image forming apparatus in Embodiment 2 are identical or similar to those in Embodiment 1, and therefore not explained here.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, while the image forming apparatus in the aforementioned embodiment is a color image forming apparatus, the feature of the present disclosure can also be applied to a monochrome image forming apparatus.

What is claimed is:

1. An image forming apparatus, comprising:

a photoconductor;

an exposure device configured to irradiate the photoconductor with light on the basis of an exposure signal and thereby form an electrostatic latent image; and a toner amount calculating unit configured to calculate a toner consumption amount on the basis of the exposure signal;

wherein the toner amount calculating unit (a) determines a distribution pattern of the electrostatic latent image on the basis of the exposure signal, (b) determines an electric field variation level of a target pixel on the basis of the distribution pattern of the electrostatic latent image or the exposure signal, (c) determines an electric field intensity of the target pixel on the basis of (c1) a value of the target pixel in the distribution pattern of the electrostatic latent image and (c2) the electric field variation level, and (d) determines a toner consumption amount corresponding to the electric field intensity; and using spatial filters independently of each other in a primary scanning direction and in a secondary scanning direction, the toner amount calculating unit determines the electric field variation level of the target pixel on the basis of (a) the distribution pattern of the electrostatic latent image or (b) the exposure signal.

2. The image forming apparatus according to claim 1, wherein the toner amount calculating unit determines the electric field variation level of the target pixel on the basis of the distribution pattern of the electrostatic latent image using unsharp mask filters independently of each other in a primary scanning direction and in a secondary scanning direction.

3. The image forming apparatus according to claim 1, wherein the toner amount calculating unit determines the electric field variation level of the target pixel on the basis of the exposure signal using Difference-of-Gaussian filters independently of each other in a primary scanning direction and in a secondary scanning direction.

4. The image forming apparatus according to claim 1, wherein the toner amount calculating unit determines the distribution pattern of the electrostatic latent image on the basis of the exposure signal using Gaussian filters independently of each other in a primary scanning direction and in a secondary scanning direction.

5. A toner amount calculating method in an image forming apparatus that comprises a photoconductor and an exposure device configured to irradiate the photoconductor with light on the basis of an exposure signal and thereby form an electrostatic latent image, comprising the steps of:

determining a distribution pattern of the electrostatic latent image on the basis of the exposure signal in an electrostatic latent image distribution determining step;

determining an electric field variation level of a target pixel on the basis of the distribution pattern of the electrostatic latent image or the exposure signal in an electric field variation level determining step; and determining an electric field intensity of the target pixel on the basis of (a) a value of the target pixel in the distribution pattern of the electrostatic latent image and (b) the electric field variation level and determining a toner consumption amount corresponding to the electric field intensity;

wherein in the electric field variation level determining step, using spatial filters independently of each other in a primary scanning direction and in a secondary scanning direction, the electric field variation level of the target pixel is determined on the basis of (a) the distribution pattern of the electrostatic latent image and (b) the exposure signal.

* * * * *